US008443975B2

(12) United States Patent
Butch, Jr. et al.

(10) Patent No.: US 8,443,975 B2
(45) Date of Patent: May 21, 2013

(54) ENHANCED EDGE PROTECTOR

(75) Inventors: Theodore J. Butch, Jr., Tracy, CA (US); John M. Kruelle, Glendale, AZ (US); Lawrence J. Ullmann, Scottsdale, AZ (US)

(73) Assignee: Illinois Tool Works Inc., Glenview, IL (US)

( * ) Notice: Subject to any disclaimer, the term of this patent is extended or adjusted under 35 U.S.C. 154(b) by 125 days.

(21) Appl. No.: 13/074,791

(22) Filed: Mar. 29, 2011

(65) Prior Publication Data

US 2012/0000815 A1 Jan. 5, 2012

Related U.S. Application Data

(60) Provisional application No. 61/361,104, filed on Jul. 2, 2010.

(51) Int. Cl.
*B65D 85/48* (2006.01)

(52) U.S. Cl.
USPC ..... 206/453; 206/586

(58) Field of Classification Search
USPC ..... 206/453, 521, 586, 591–594; 248/345.1
See application file for complete search history.

(56) References Cited

U.S. PATENT DOCUMENTS 1,989,794 A * 2/1935 Duvall ..... 206/586
4,771,893 A * 9/1988 Liebel ..... 206/586
5,131,541 A * 7/1992 Liebel ..... 206/453
5,181,611 A * 1/1993 Liebel ..... 206/453
5,813,537 A * 9/1998 DeReu et al. ..... 206/453
6,527,119 B1 3/2003 Markert et al.
6,540,080 B2 * 4/2003 Moreyra ..... 206/586
2005/0087663 A1 * 4/2005 Schroeder ..... 248/345.1

OTHER PUBLICATIONS

International Search Report and the Written Opinion of the International Searching Authority issued on Jul. 29, 2011, in connection with PCT/US2011/037266/.
ITW Angleboard product brochure dated Feb. 2009, available at http://www.angleboard.com/Products/Angleboard174.aspx.

* cited by examiner

*Primary Examiner* — Luan K Bui
(74) *Attorney, Agent, or Firm* — Levenfeld Pearlstein, LLC

(57) ABSTRACT

An edge protector includes a first section formed from a laminate of paper or paperboard plies. The first section being formed in an angled configuration defining first and second legs and defining a first apex therebetween. In addition, the first apex defines first inside and second outside corners and the first and second legs and the first apex define a first width. The edge protector also includes a second section formed from a laminate of paper or paperboard plies overlying a core element. The core element and laminate are formed in an angled configuration similar to the first section. The second section defines third and fourth legs and defines a second apex therebetween. In addition, the second apex defines third inside and fourth outside corners, and the third and fourth legs and the second apex define a second width that is less than the first width. The plies overlying the core element wrap around the fourth outside corner and extend inwardly toward the third inside corner. The first and second sections are affixed to one another with the first and third legs abutting one another and the second and fourth legs abutting one another.

18 Claims, 1 Drawing Sheet

ENHANCED EDGE PROTECTOR

CROSS REFERENCE TO RELATED APPLICATIONS

This application claims the benefit of U.S. Provisional Application No. 61/361,104, filed Jul. 2, 2010.

FIELD OF THE DISCLOSURE

The present disclosure relates generally to an edge protector and, more particularly, to a packaging edge protector having a small profile for protecting the edges of articles to be packaged.

BACKGROUND

Generally, edge protectors are used to package articles that have vulnerable corners or edges that may be subjected to damage. For example, objects as wide ranging as glass panels to appliances have edges or corners that can be easily damaged or broken and, if damaged or broken, the value of such objects will likely be decreased or may even be completely lost.

Edge protectors are known that are formed from a material with an angled or generally L-shaped cross-section. In one example, the edge protector is manufactured from multiple layers or plies of paperboard, laminated with glue, and formed into a rigid approximately 90 degree angle. Such an edge protector, which provides exceptional strength for load stability and packaging protection, is commercially available from ITW ANGLEBOARD of Lake Zurich, Ill. Typical edge protectors are relatively rigid longitudinally along a length of the edge protector and across a cross-section of the edge protector such that walls of the angled edge protector do not generally fold toward or away from each other.

One such edge protector is disclosed in Markert et al. U.S. Pat. No. 6,527,119 ("Markert"), which discloses an angled edge protector formed from a laminate material including a plurality of paper plies. In Markert, a width of the plies differs to increase the thickness of the edge protector at an apex thereof, as compared to distal portions of legs that form the angled edge protector. Another angled edge protector is disclosed in DeReu et al. U.S. Pat. No. 5,813,537 ("DeReu"), which discloses an angled edge protector with a relieved area at an apex thereof to relieve forces at the apex or corner. Both Markert and DeReu are commonly assigned with the present application and are incorporated herein by reference.

While such prior known edge protectors function well, there is a need for a low-profile, cost effective corner edge protector. Desirably, such an edge protector can provide corner relief, as well as, the necessary structural integrity and strength for objects that have vulnerable corners and edges.

BRIEF SUMMARY

Various embodiments of the present disclosure provide an edge protector that includes a first section formed from a laminate of paper or paperboard plies. The first section being formed in an angled configuration defining first and second legs and defining a first apex therebetween. In addition, the first apex defines first inside and second outside corners, and the first and second legs and the first apex define a first width. The edge protector also includes a second section formed from a laminate of paper or paperboard plies overlying a core element. The core element and laminate are formed in an angled configuration similar to the first section. The second section defines third and fourth legs and defines a second apex therebetween. In addition, the second apex defines third inside and fourth outside corners, and the third and fourth legs and the second apex define a second width that is less than the first width. The plies overlying the core element wrap around the fourth outside corner and extend inwardly toward the third inside corner. The first and second sections are affixed to one another with the first and third legs abutting one another and the second and fourth legs abutting one another.

Still other embodiments of the present disclosure provide an edge protector that includes a first section formed from a laminate of paper or paperboard plies. The first section is formed in an angled configuration defining first and second legs and defining a first apex therebetween. In addition, the first apex defines first inside and second outside corners and the first and second legs and the first apex define a first width. The edge protector further includes a second section formed from a laminate of folded over paper or paperboard plies formed in an angled configuration similar to the first section. The second section defines third and fourth legs and defines a second apex therebetween. In addition, the second apex defines third inside and fourth outside corners, and the third and fourth legs and the second apex define a second width that is less than the first width. The first and second sections are affixed to one another with the first and third legs abutting one another and the second and fourth legs abutting one another.

In yet other embodiments of the present disclosure, the second section is positioned at the first inside corner of the first section. Alternately, the second section is positioned at the second outside corner of the first section. The pairs of legs of each section may be formed at an angle of about 90 degrees to one another. Optionally, the first and second sections can be provided with an overwrap such that the edge protector has a unitary appearance.

In this manner, the present disclosure provides a low-profile, cost effective edge protector.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
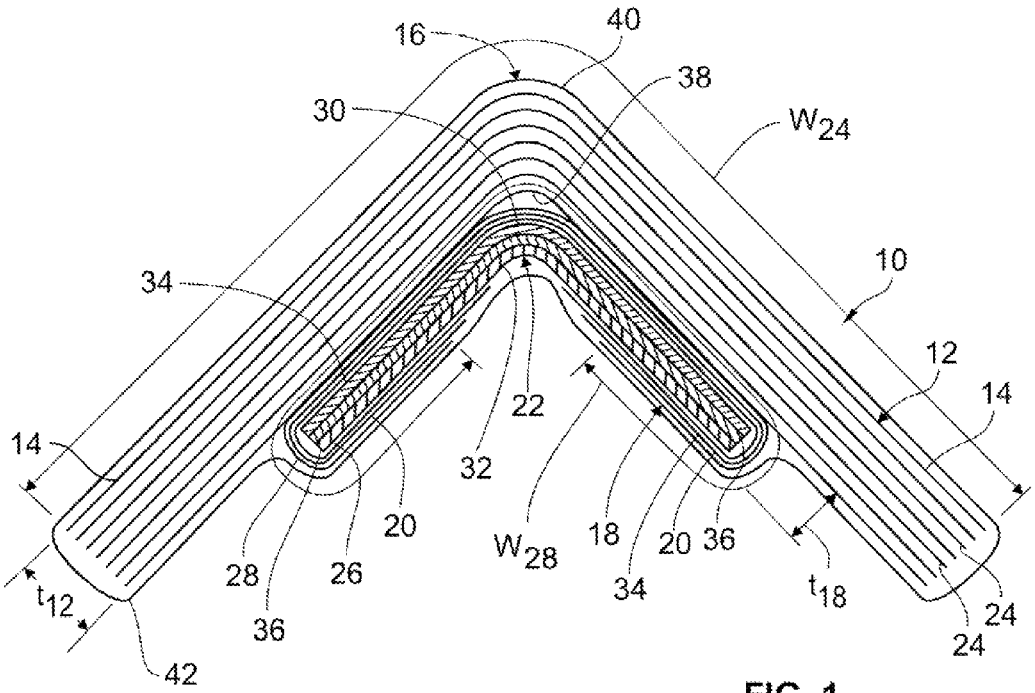
FIG. 1 is a cross-sectional view of an enhanced edge protector in accordance with an embodiment of the present disclosure.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated. The words "a" or "an" are to be taken to include both the singular and the plural. Conversely, any reference to plural items shall, where appropriate, include the singular.

Referring now to the figures and in particular to FIG. 1, there is shown an enhanced edge protector 10 formed having two distinct sections. A first section 12 is formed having a wider area, or longer legs 14 extending from an apex or corner 16. A second section 18 has a narrower area, or shorter legs 20 (compared to the first section) extending from an apex or corner 22.

The first section 12 may be formed as a standard angle board with paper or paperboard plies 24 that can each be of the same width $w_{24}$. In one non-limiting example, the width $w_{24}$ is about 4.0 inches (about 10.2 cm) and the width of each leg 14 is about 2.0 inches (about 5.1 cm). Alternatively, the first section 12 may be formed, as described in Markert, with intermediate plies 24 having a different, narrower width than other plies. It will be appreciated that if the plies 24 are all of the same width, then the cross-sectional thickness $t_{12}$ of the first section 12 will be about constant throughout. On the other hand, if the first section 12 is formed with intermediate plies 24 having a narrower width, then a center region of the section may have a greater thickness than edge portions of the board. Both such configurations are considered within the scope and spirit of the present disclosure.

The second section 18 may be formed as disclosed in DeReu, that is, a core portion 26 has wrapped around it plies of paper or paperboard 28 that extend fully around an outside corner 30 of the core and wrap inwardly toward an inside angle or corner 32 of the core. Each ply 28 has a width $w_{28}$. In one example, the width $w_{28}$ of the plies 28 is about 4.0 inches (about 10.2 cm), similar to the plies 24, wherein the plies 28 are wrapped around the outside corner 30 of the core portion 26 and legs of the plies 28, similar to the legs 14, are folded inwardly toward the apex 22.

All of the plies may have equal widths $w_{28}$ such that the plies 28 that are adjacent or closer to the core 26 reach farther inward toward the inside corner 32 of the second section 18. Accordingly, the plies 28 that are farther outward of the core 26 extend a lesser distance toward the inside corner 32. In this manner, a cross-sectional thickness $t_{18}$ of the second section 18 may be smallest near the corner 22 and greatest outward along distal portions 34 of the legs 20 of the section 18. The plies 28 wrapped over free ends 36 of the core 26, provide enhanced strength compared to a board of similar size, leg width, and thickness.

It will also be appreciated that the second section 18 can be formed from plies 28 with different widths $w_{28}$ so that the plies 28 all substantially extend to the same extent towards the inside corner 32 of the core portion 26. In one example, all of the plies 28 extend fully to the inside corner 32 of the core portion 26. This would of course result in the legs 20 having a substantially constant thickness $t_{18}$ from the apex 22 outward to the free ends 36 of the legs.

The core 26 can be formed from any of a number of materials, including paper or paperboard that can be laminated, plastics, and the like. The core 26 can also be formed from plies of paper or paperboard that are folded over to provide support for the application of the plies 28. As such, the entire second section 18 can be formed entirely of folded over plies 28 without a distinct or separately formed core 26.

Figure 2:
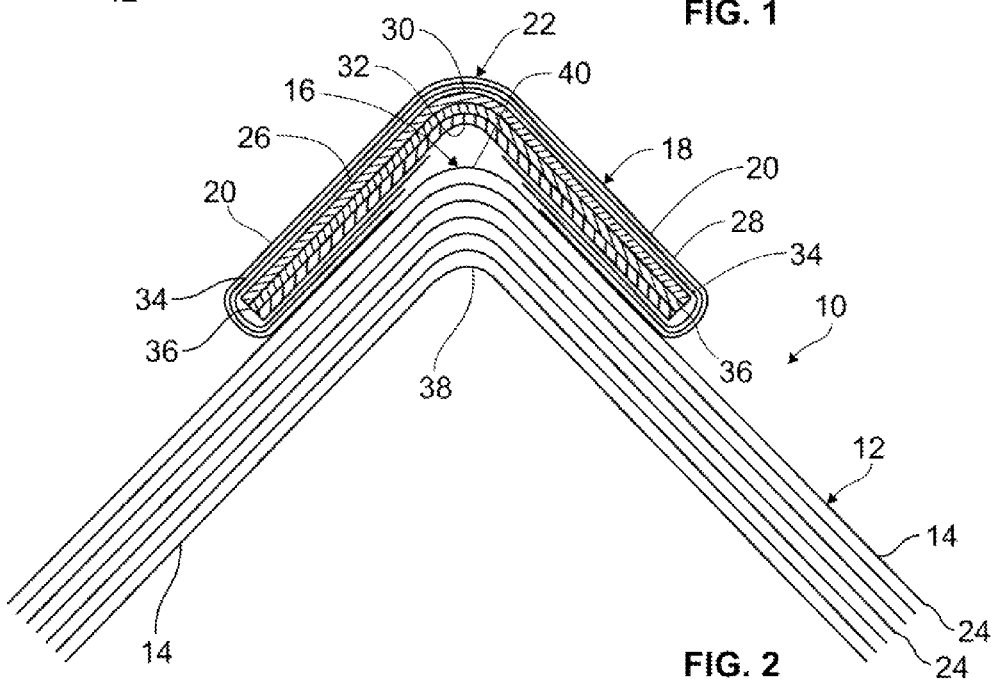
FIG. 2 is a cross-sectional view of an enhanced edge protector in accordance with another embodiment of the present disclosure.

The enhanced edge protector 10 can be fabricated with the second section 18 positioned at an inside corner 38 of the first section 12, as illustrated in FIG. 1, or with the second section 18 positioned at an outside corner 40, as illustrated in FIG. 2. In either configuration, the enhanced edge protector 10 provides increased protection and strength, in a smaller profile packaging element with reduced material compared to other, comparable edge protectors.

The sections 12, 18 can be affixed to each other by glue, by a lamination process, heat sealing, or using any other means as will be appreciated by those skilled in the art. Optionally, as illustrated in FIG. 1, an overwrap 42 can be provided over the joined first and second sections 12, 18 to cover the sections 12, 18. The wrap 42 provides an aesthetically pleasing appearance to the edge protector 10, and can further add strength and liquid, such as water, resistance, to prevent degradation due to environmental conditions.

While the present description is provided with reference to a lamination of paper or paperboard and adhesive plies 24, 28, it will be appreciated by those skilled in the art that one or both of the sections 12, 18 can be formed from a material in which the adhesive characteristics are provided by, for example, the use of plies of a polyethylene coated paper or paperboard that is subjected to heat and pressure to create the sections and that such heat sealed coated paper and paperboard embodiments are within the scope and spirit of the present disclosure.

It will also be appreciated that the present enhanced edge protector 10 provides a low-profile packaging element. The edge protector 10 can provide both corner relief (as shown, for example, in FIG. 1) and necessary structural integrity for objects that have vulnerable corners and edges.

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. An edge protector, comprising:

a first section formed from a laminate of paper or paperboard plies, the first section being formed in an angled configuration defining first and second legs and defining a first apex therebetween, the first apex defining first inside and second outside corners, the first and second legs and the first apex defining a first width; and a second section formed from a laminate of paper or paperboard plies overlying a core element, the core element and laminate formed in an angled configuration similar to the first section, the second section defining third and fourth legs and defining a second apex therebetween, the second apex defining third inside and fourth outside corners, the third and fourth legs and the second apex defining a second width that is less than the first width, wherein the plies overlying the core element wrap around the fourth outside corner and extend inwardly toward the third inside corner, wherein the first and second sections are affixed to one another with the first and third legs abutting one another and the second and fourth legs abutting one another, and including an overwrap applied over the first and second sections.

2. The edge protector of claim 1 wherein the second section is position at the first inside corner of the first section.

3. The edge protector of claim 1 wherein the second section is position at the second outside corner of the first section.

4. The edge protector of claim 1 wherein the core element is formed from paper or paperboard.

5. The edge protector of claim 1 wherein the first and second legs of the first section and the third and fourth legs of the second section are formed at an angle of about 90 degrees to one another.

6. The edge protector of claim 1 wherein a thickness of third and fourth legs increases from the second apex outwardly toward free ends of the third and fourth legs.

7. The edge protector of claim 6 wherein the second section defines a relieved portion at the second apex.

8. The edge protector of claim 1 wherein the first section is formed from laminated paper plies.

9. The edge protector of claim 1 wherein the second section is formed from laminated paper plies.

10. The edge protector of claim 9 wherein the core element is formed from laminated paper plies.

11. The edge protector of claim 1 wherein one or both of the first and second sections is formed from a laminate of coated paper or paperboard plies, wherein the laminate is formed by applying heat and pressure to the plies.

12. The edge protector of claim 1 wherein the overwrap is formed from a coated paper or paperboard.

13. The edge protector of claim 1 wherein the core element is formed from a laminate of coated paper or paperboard plies, wherein the laminate is formed by applying heat and pressure to the plies.

14. An edge protector, comprising:

a first section formed from a laminate of paper or paperboard plies, the first section being formed in an angled configuration defining first and second legs and defining a first apex therebetween, the first apex defining first inside and second outside corners, the first and second legs and the first apex defining a first width; and a second section formed from a laminate of folded over paper or paperboard plies formed in an angled configuration similar to the first section, the second section defining third and fourth legs and defining a second apex therebetween, the second apex defining third inside and fourth outside corners, the third and fourth legs and the second apex defining a second width that is less than the first width, wherein the first and second sections are affixed to one another with the first and third legs abutting one another and the second and fourth legs abutting one another, and including an overwrap applied over the first and second sections.

15. The edge protector of claim 14 wherein the paper or paperboard plies of the second section are folded inwardly toward the third inside corner.

16. The edge protector of claim 15 wherein the paper or paperboard plies of the second section are all substantially the same width to create a relieved portion at the second apex.

17. The edge protector of claim 14 wherein the second section is positioned at the first inside corner of the first section.

18. The edge protector of claim 14 wherein the second section is positioned at the second outside corner of the first section.

* * * * *